US009955271B2

(12) United States Patent
Gustafsson et al.

(10) Patent No.: US 9,955,271 B2
(45) Date of Patent: Apr. 24, 2018

(54) SUSPENDED COMPONENTS IN AUDITORY PROSTHESES

(71) Applicants: Johan Gustafsson, Macquarie University (AU); Dan Nyström, Macquarie University (AU); Tommy Bergs, Macquarie University (AU)

(72) Inventors: Johan Gustafsson, Macquarie University (AU); Dan Nyström, Macquarie University (AU); Tommy Bergs, Macquarie University (AU)

(73) Assignee: COCHLEAR LIMITED, Macquarie University ( * ) Notice: Subject to any disclaimer, the term of this patent is extended or adjusted under 35 U.S.C. 154(b) by 0 days.

(21) Appl. No.: 15/092,378

(22) Filed: Apr. 6, 2016

(65) Prior Publication Data

US 2016/0345110 A1 Nov. 24, 2016

Related U.S. Application Data

(60) Provisional application No. 62/164,314, filed on May 20, 2015.

(51) Int. Cl.
*H04R 25/00* (2006.01)

(52) U.S. Cl.
CPC ..... *H04R 25/606* (2013.01); *H04R 25/456* (2013.01); *H04R 25/65* (2013.01); *H04R 2460/13* (2013.01)

(58) Field of Classification Search
CPC .... H04R 25/606; H04R 25/456; H04R 25/65; H04R 2460/13
See application file for complete search history.

(56) References Cited

U.S. PATENT DOCUMENTS

| | | | |
|---|---|---|---|
| 2006/0045298 | A1 | 3/2006 | Westerkull |
| 2008/0319250 | A1 | 12/2008 | Asnes |
| 2011/0268303 | A1 | 11/2011 | Ahsani |

FOREIGN PATENT DOCUMENTS

| | | | |
|---|---|---|---|
| KR | 10-2009-0079527 | | 7/2009 |
| KR | 10-1121170 | B1 | 3/2012 |
| KR | 101121170 | B1 | 3/2012 |

OTHER PUBLICATIONS

International Search Report for Application No. PCT/IB2016/000632 dated Sep. 23, 2016.
International Preliminary Report on Patentability for PCT/US2016/000632, dated Nov. 30, 2017, 10 pages.

*Primary Examiner* — Tuan D Nguyen
(74) *Attorney, Agent, or Firm* — Merchant & Gould P.C.

(57) ABSTRACT

In bone conduction auditory prostheses, a suspension of the electronic components relative to the vibrating mass is beneficial for a number of reasons. The suspension systems depicted also function as a seal, so as to prevent infiltration of direct, water, or other contaminants into the housing. The present technology utilizes a combination suspension and sealing system that seals the housing of an auditory prosthesis while still providing sufficient suspension functionality.

17 Claims, 12 Drawing Sheets

SUSPENDED COMPONENTS IN AUDITORY PROSTHESES

BACKGROUND

Hearing loss, which can be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient (i.e., the inner ear of the recipient) to bypass the mechanisms of the middle and outer ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss can retain some form of residual hearing because some or all of the hair cells in the cochlea function normally.

Individuals suffering from conductive hearing loss often receive a conventional hearing aid. Such hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to conventional hearing aids, which rely primarily on the principles of air conduction, certain types of hearing prostheses commonly referred to as bone conduction devices, convert a received sound into vibrations. The vibrations are transferred through the skull to the cochlea causing motion of the perilymph and stimulation of the auditory nerve, which results in the perception of the received sound. Bone conduction devices are suitable to treat a variety of types of hearing loss and can be suitable for individuals who cannot derive sufficient benefit from conventional hearing aids.

SUMMARY

In bone conduction auditory prostheses, a suspension of the electronic components relative to the vibrating mass is beneficial for a number of reasons. For example, if vibrations are isolated from the microphones, feedback can be reduced or eliminated. In another example, minimization of the vibrating coupling mass helps to maximize the transmission of vibrations through the skin. Utilizing a suspension system with a seal, so as to prevent infiltration of dirt, water, or other contaminants into the housing is desirable. However, creating too stiff of a suspension in an effort to maintain sealing capability can adversely affect the benefits attendant with a suspension system. The present technology utilizes a combination suspension and sealing system that seals the housing of an auditory prosthesis while still providing sufficient suspension functionality.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

The sealing and suspension technologies described herein can typically be utilized with bone conduction devices. Such devices include transcutaneous bone conduction devices that transmit vibrations through the skin of a recipient to the recipient's skull, as well as percutaneous bone conduction devices that anchor directly to a recipient's skull. Transcutaneous bone conduction devices can be biased toward the recipient's skull by a magnetic force, an adhesive, a hard or soft headband or anatomical features (such as the pinna). In percutaneous bone conduction devices, an external portion thereof is secured to a bone anchor with, e.g., a snap connection. By utilizing the sealing and suspension technologies described herein, the external portion of the bone conduction device can be sealed against intrusion of water, sweat, dirt, and so on, while still providing sufficient damping of vibration so as to reduce feedback.

The technologies described herein contemplate sealing and suspension systems utilized in an external portion of a bone conduction device that can be utilized in both percutaneous and transcutaneous applications. Such devices can include a housing containing sound processing components, microphones, and a vibration element. When used in a transcutaneous application, a vibration transmission element is attached to the vibration element and held on the skin (typically via magnetic components). When used in a percutaneous application, the vibration element can be connected to the anchor that penetrates the skin, e.g., by a post or shaft having a removable snap coupling apparatus that connects to the anchor.

Figure 1A:
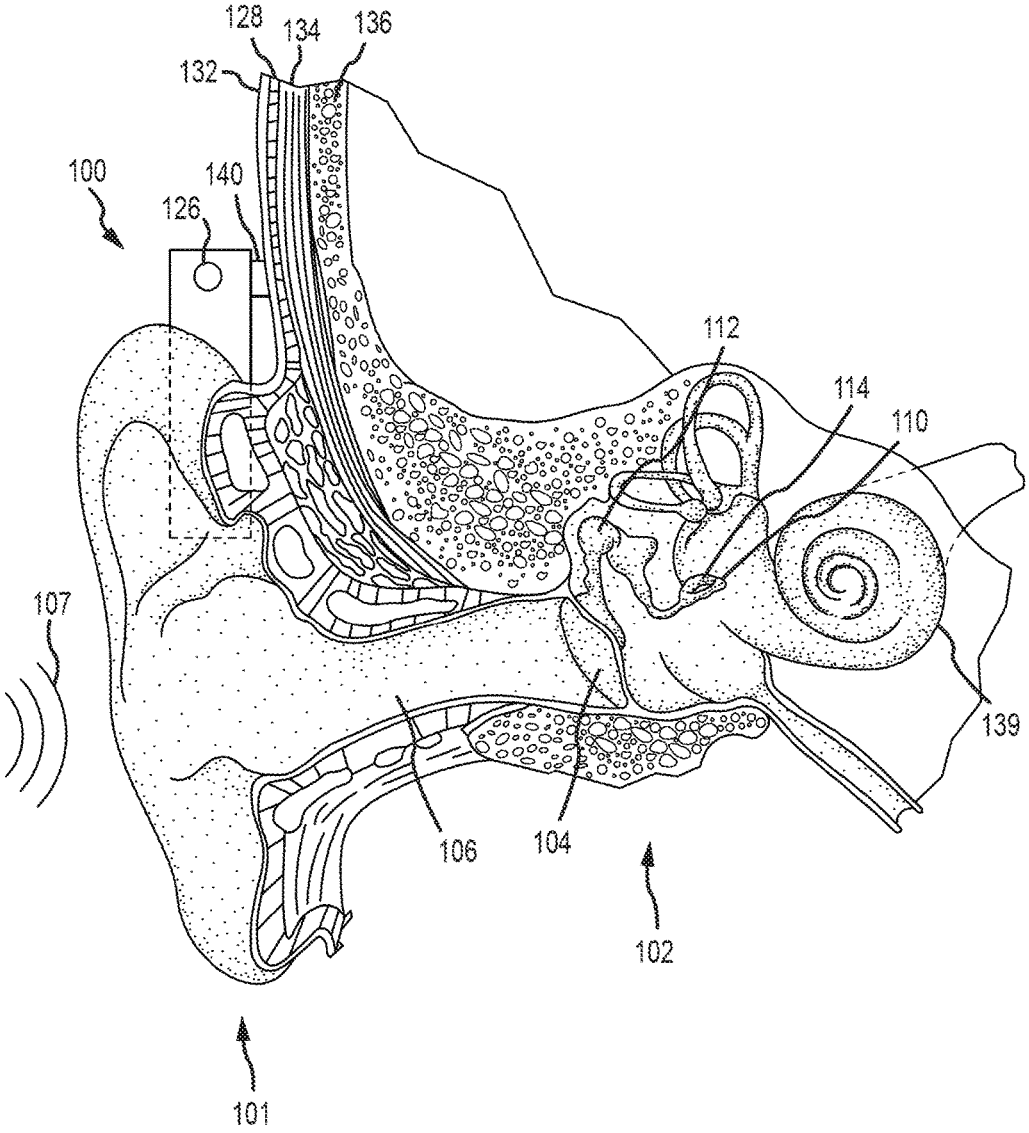
FIG. 1A depicts a partial perspective view of a percutaneous bone conduction device worn on a recipient.

FIG. 1A depicts a partial perspective view of a percutaneous bone conduction device 100 positioned behind outer ear 101 of the recipient and comprises a sound input element 126 to receive sound signals 107. The sound input element 126 can be a microphone, telecoil or similar. In the present example, sound input element 126 can be located, for example, on or in bone conduction device 100, or on a cable extending from bone conduction device 100. Also, bone conduction device 100 comprises a digital sound processor (not shown), a vibrating electromagnetic actuator and/or various other operational components.

More particularly, sound input device 126 converts received sound signals into electrical signals. These electrical signals are processed by the sound processor. The sound processor generates control signals that cause the actuator to vibrate. In other words, the actuator converts the electrical signals into mechanical force to impart vibrations to skull bone 136 of the recipient.

Bone conduction device 100 further includes transmission element 140 to transfers vibrations from the bone conduction device to the recipient. The illustrated transmission element 140 includes a coupling apparatus to attach bone conduction device 100 to the recipient. In the example of FIG. 1A, the coupling apparatus of transmission element 140 is attached to an anchor system (not shown) implanted in the recipient. An exemplary anchor system (also referred to as a fixation system) can include a percutaneous abutment fixed to the recipient's skull bone 136. The abutment extends from skull bone 136 through muscle 134, fat 128 and skin 132 so that transmission element 140 can be attached thereto. Such a percutaneous abutment provides an attachment location for coupling apparatus that facilitates efficient transmission of mechanical force.

It is noted that sound input element 126 can comprise devices other than a microphone, such as, for example, a telecoil, etc. In another aspect, sound input element 126 can be located remote from the bone conduction device 100 and can take the form of a microphone or the like located on a so-called behind-the-ear (BTE) device that hangs from the recipient's ear or forms part of a body worn component, such as a wireless accessory. Alternatively, sound input element 126 can be subcutaneously implanted in the recipient, or positioned in the recipient's ear canal or positioned within the pinna. Sound input element 126 can also be a component that receives an electronic signal indicative of sound, such as, from an external audio device. For example, sound input element 126 can receive a sound signal in the form of an electrical signal from an MP3 player or a smartphone electronically connected to sound input element 126 via a wired or wireless connection.

The sound processing unit of the bone conduction device 100 processes the output of the sound input element 126, which is typically in the form of an electrical signal. The processing unit generates control signals that cause an associated actuator to vibrate. In other words, the actuator converts the electrical signals into mechanical vibrations for delivery to the recipient's skull. These mechanical vibrations are delivered by an external portion of the auditory prosthesis 100, as described below.

Figure 1B:
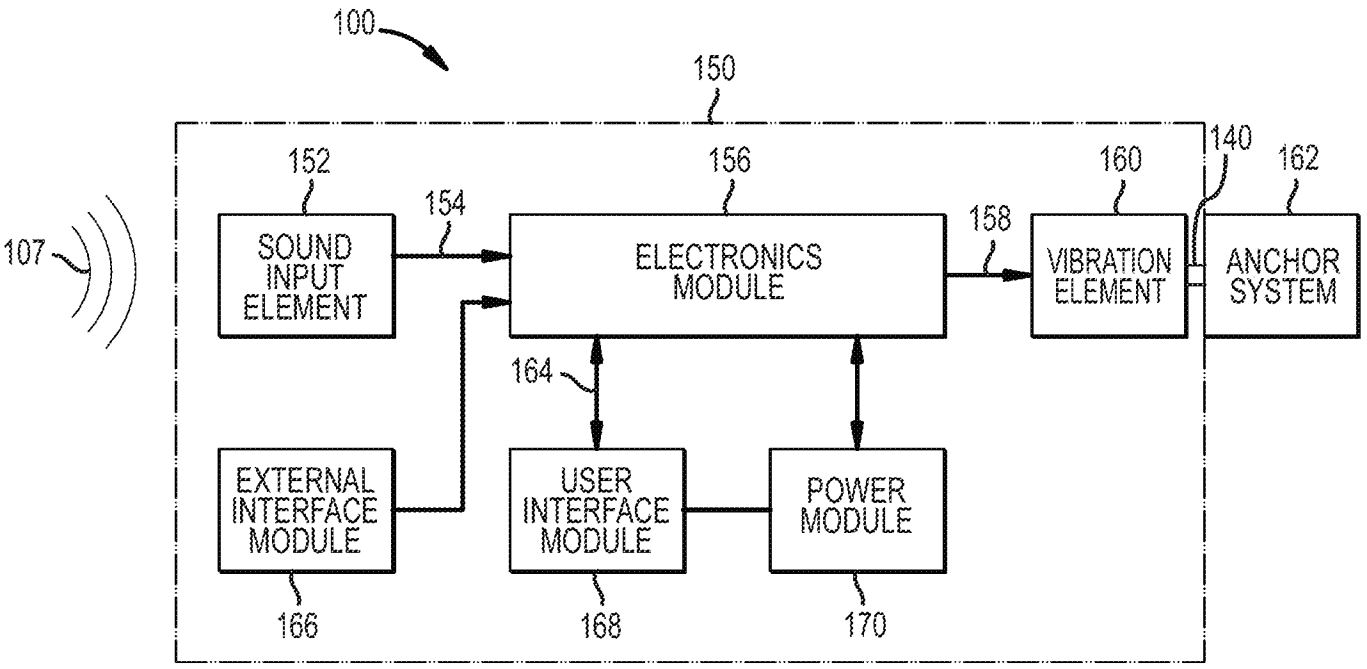
FIG. 1B is a schematic diagram of a percutaneous bone conduction device.

FIG. 1B is a schematic diagram of a percutaneous bone conduction device 100. Sound 107 is received by sound input element 152. In some arrangements, sound input element 152 is a microphone configured to receive sound 107, and to convert sound 107 into electrical signal 154. Alternatively, sound 107 is received by sound input element 152 as an electrical signal. As shown in FIG. 1B, electrical signal 154 is output by sound input element 152 to electronics module 156. Electronics module 156 is configured to convert electrical signal 154 into adjusted electrical signal 158. As described below in more detail, electronics module 156 can include a sound processor, control electronics, transducer drive components, and a variety of other elements.

As shown in FIG. 1B, transducer or vibration element 160 receives adjusted electrical signal 158 and generates a mechanical output force in the form of vibrations that are delivered to the skull of the recipient via a transmission element 140, as described above. The transmission element 140 connects to the anchor system 162, so as to couple the anchor system 162 to bone conduction device 100. Delivery of this output force causes motion or vibration of the recipient's skull, thereby activating the hair cells in the recipient's cochlea (not shown) via cochlea fluid motion.

FIG. 1B also illustrates power module 170. Power module 170 provides electrical power to one or more components of bone conduction device 100. For ease of illustration, power module 170 has been shown connected only to user interface module 168 and electronics module 156. However, it should be appreciated that power module 170 can be used to supply power to any electrically powered circuits/components of bone conduction device 100.

User interface module 168, which is included in bone conduction device 100, allows the recipient to interact with bone conduction device 100. For example, user interface module 168 can allow the recipient to adjust the volume, alter the speech processing strategies, power on/off the device, etc. In the example of FIG. 1B, user interface module 168 communicates with electronics module 156 via signal line 164.

Bone conduction device 100 can further include external interface module that can be used to connect electronics module 156 to an external device, such as a fitting system. Using external interface module 166, the external device, can obtain information from the bone conduction device 100 (e.g., the current parameters, data, alarms, etc.) and/or modify the parameters of the bone conduction device 100 used in processing received sounds and/or performing other functions.

In the example of FIG. 1B, sound input element 152, electronics module 156, vibration element 160, power module 170, user interface module 168, and external interface module have been shown as integrated in a single housing, referred to as housing 150. However, it should be appreciated that in certain examples, one or more of the illustrated components can be housed in separate or different housings. For example, the sound input element 152 and electronics module 156 can be disposed in a BTE device that is physically isolated from the actuator. Similarly, it should also be appreciated that in such aspects, direct connections between the various modules and devices are not necessary and that the components can communicate, for example, via wireless connections.

Figure 2:
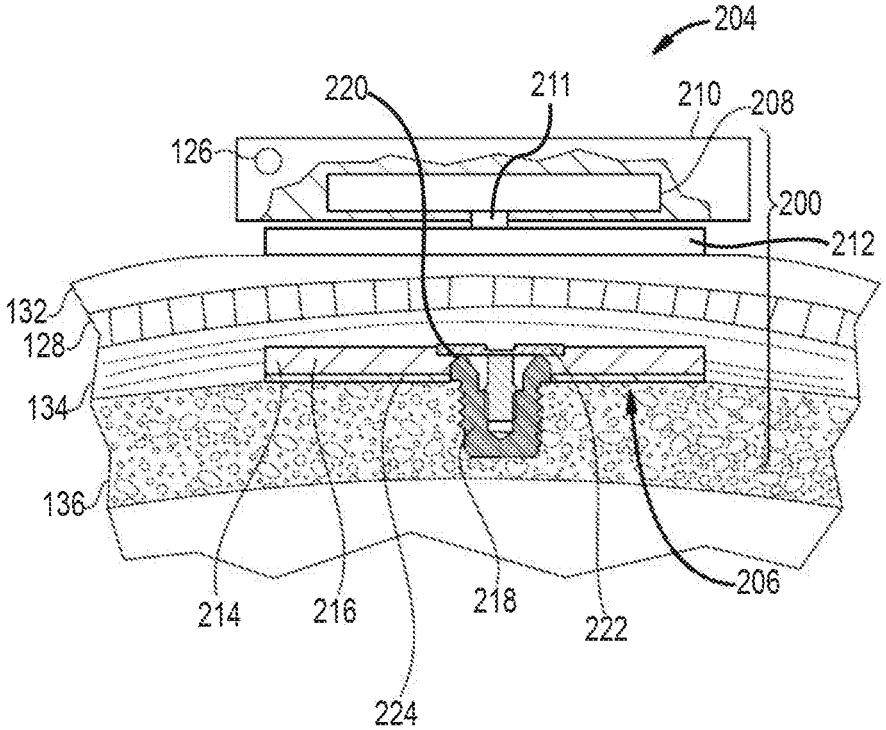
FIG. 2 depicts a cross-sectional schematic view of a transcutaneous bone conduction device worn on a recipient.

FIG. 2 depicts an exemplary aspect of a transcutaneous bone conduction device 200 that includes an external portion 204 and an implantable portion 206. The transcutaneous bone conduction device 200 of FIG. 2 is a passive transcutaneous bone conduction device in that a transducer or vibration element 208 is located in the external portion 204. In general, the external portion 204 can include the control and sound processing components depicted above in FIG. 1B. For clarity however, these components are generally not depicted; instead, structural elements particular to a transcutaneous bone conduction device 200 are shown.

Vibration element 208 is located in housing 210 of the external component, and is coupled via a transmission element 211 to the plate 212, which can be discrete from the housing 210 as depicted, or disposed within the housing 210. Plate 212 can be in the form of a permanent magnet and/or in another form that generates and/or is reactive to a magnetic field, or otherwise permits the establishment of magnetic attraction between the external portion 204 and the implantable portion 206 sufficient to hold the external portion 204 against the skin of the recipient. In other examples, magnets or magnetic materials can be discrete from plate 212. Magnetic attraction can be further enhanced by utilization of a magnetic implantable plate 216. In alternative aspects, multiple magnets in both the external portion 204 and implantable portion 206 can be utilized.

In an exemplary aspect, the vibration element 208 is a device that delivers vibration stimulus to the skull of a recipient. In operation, sound input element 126 converts sound into electrical signals. Specifically, the transcutaneous bone conduction device 200 provides these electrical signals to vibration element 208, or to a sound processor (not shown) that processes the electrical signals, and then provides those processed signals to vibration element 208. The vibration element 208 converts the electrical signals (processed or unprocessed) into vibrations. Because vibration element 208 is mechanically coupled to plate 212, the vibrations are transferred from the vibration element 208 to plate 212 via transmission element 211. Implantable plate assembly 214 is part of the implantable portion 206, and can be made of a ferromagnetic material that can be in the form of a permanent magnet, that generates and/or is reactive to a magnetic field, or otherwise permits the establishment of a magnetic attraction between the external portion 204 and the implantable portion 206 sufficient to hold the external portion 204 against the skin 132 of the recipient. Accordingly, vibrations produced by the vibration element 208 of the external portion 204 are transferred from plate 212 across the skin 132 to implantable plate 216 of implantable plate assembly 214. This can be accomplished as a result of mechanical conduction of the vibrations through the skin 132, resulting from the external portion 204 being in direct contact with the skin 132 and/or from the magnetic field between the two plates 212, 216. These vibrations are transferred without a component penetrating the skin 132, fat 128, or muscular 134 layers on the head.

As can be seen, the implantable plate assembly 214 is substantially rigidly attached to bone fixture 218 in this aspect. Implantable plate assembly 214 includes through hole 220 that is contoured to the outer contours of the bone fixture 218, in this case, a bone screw that is secured to the bone 136 of the skull. This through hole 220 thus forms a bone fixture interface section that is contoured to the exposed section of the bone fixture 218. In an exemplary aspect, the sections are sized and dimensioned such that at least a slip fit or an interference fit exists with respect to the sections. Plate screw 222 is used to secure implantable plate assembly 214 to bone fixture 218. As can be seen in FIG. 2, the head of the plate screw 222 is larger than the hole through the implantable plate assembly 214, and thus the plate screw 222 positively retains the implantable plate assembly 214 to the bone fixture 218. In certain aspect, a silicon layer 224 is located between the implantable plate 216 and bone 136 of the skull.

The external portion of a bone conduction auditory prosthesis can be utilized in both the percutaneous application of FIGS. 1A and 1B, and the transcutaneous application of FIG. 2. For example, a bone conduction auditory prosthesis can include a housing containing, e.g., the various modules and elements depicted in FIG. 1B. Those elements include vibration element 160 (FIG. 1B), which is equivalent to vibration element 208 (FIG. 2). The vibration element can be connected to a transmission element 140 (FIG. 1B) or 211 (FIG. 2). Such a transmission element can be connected to an anchor system 162 (FIG. 1B) in a percutaneous bone conduction application or a plate in a transcutaneous bone conduction application. Alternatively, the transmission element can include a plate or other generally flat component or element 212 (FIG. 2) to be utilized in a transcutaneous application. This increases manufacturing efficiencies by allowing the same bone conduction device to be used in either configuration. Such devices are described in further detail below.

Figure 3A:
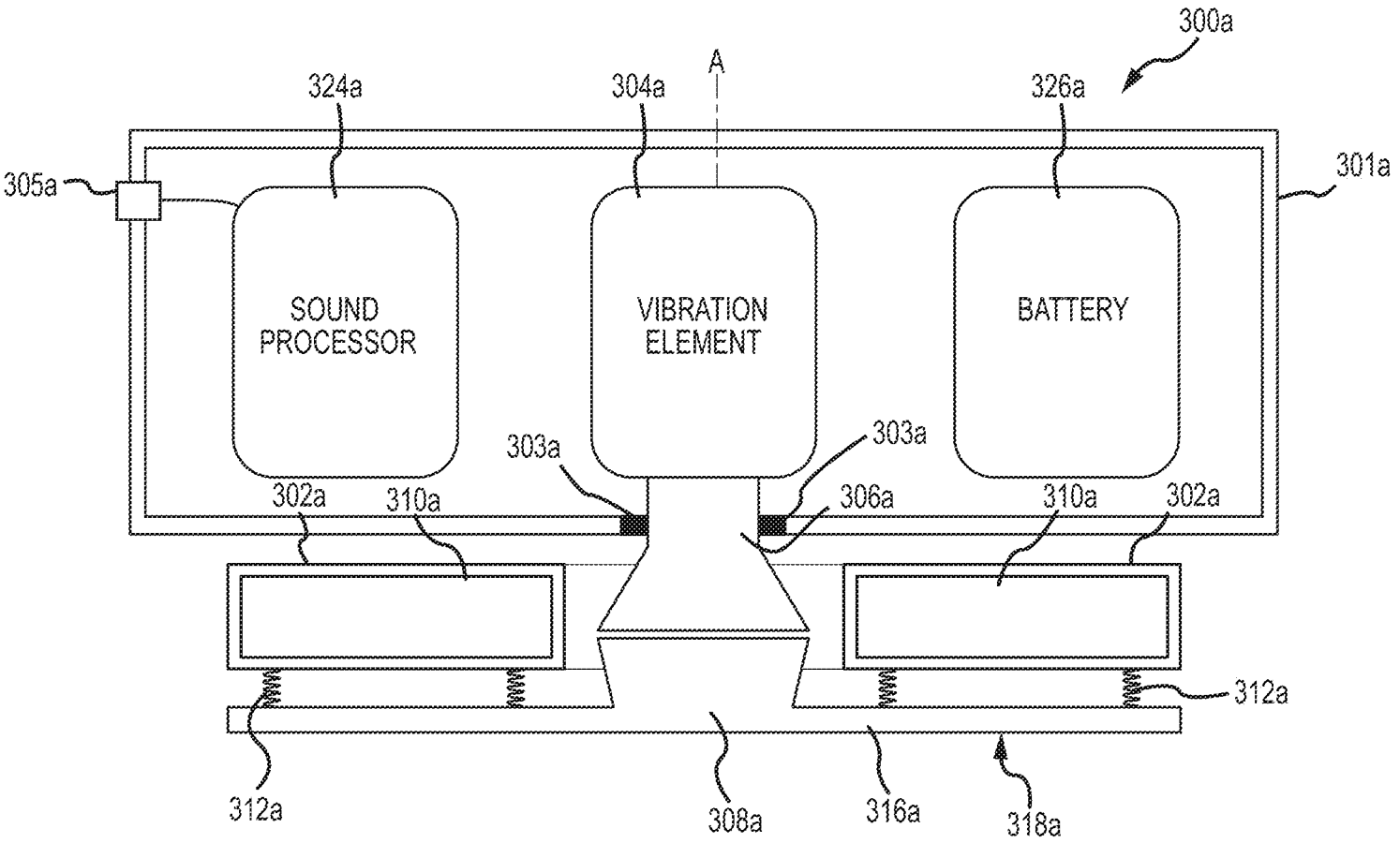
FIGS. 3A and 3B depict partial cross-sectional schematic views of external portions of transcutaneous bone conduction devices and percutaneous bone conduction devices, respectively.
Figure 3B:
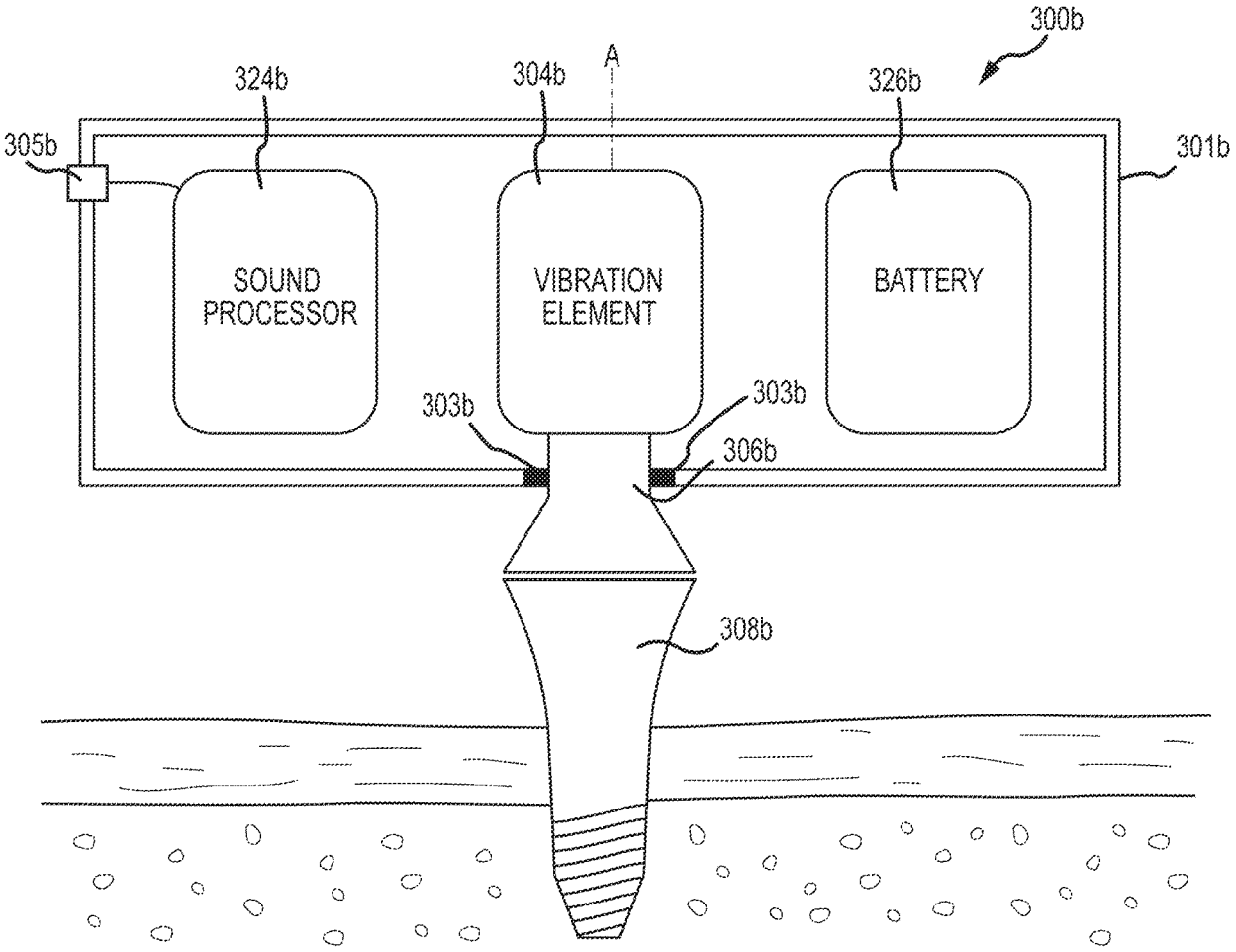

FIGS. 3A-3B depict partial cross-sectional schematic views of external portions 300*a-b* of transcutaneous bone conduction devices and percutaneous bone conduction devices, respectively. Common elements are described generally together. Each of the depicted aspects includes a housing 301*a-b* that surrounds a number of components. These components include, but are not limited to a vibration element 304*a-b*, sound processing electronics 324*a-b*, batteries 326*a-b*, and so on. Not all elements utilized in transcutaneous or percutaneous bone conduction devices are depicted in the figures, but are described elsewhere herein and known to a person of skill in the art. A microphone or other sound input element 305*a-b* is disposed on the housing 301*a-b* and is connected to the sound processor component 324*a-b*. A transmission element 306*a-b* extending through the housing 301*a-b* is connected to the vibration element 304*a-b*. A sealing and suspension system 303*a-b* is disposed between the housing 301*a-b* and the transmission element 306*a-b*. Examples of sealing and suspension systems 303*a-b* are described in more detail below. The transmission element 306*a* is connected to an enlarged element 308*a* in the form of a plate 316*a* in the case of the transcutaneous bone conduction device 300*a*.

In the transcutaneous bone conduction device 300*a* depicted in FIG. 3A, an underside 318*a* of the plate 316*a* is adapted to contact the skin of a recipient. A magnet housing 302*a* contains one or more masses 310*a*, which can be a magnet or other magnetic material. Either or both of the housing 302*a* and the masses 310*a* can be connected to the plate 316*a* with one or more resilient elements 312*a* that can further dampen unwanted vibration. Different types of resilient elements 312*a*, such as coil springs, leaf springs, torsion springs, shape-memory elements, wave springs, and elastomeric elements, can be utilized in the external portions described herein. Technologies related to the suspension of magnets or masses in bone conduction devices are described in U.S. Patent Application Ser. No. 62/043,013, filed Aug. 28, 2014, the disclosure of which is hereby incorporated by reference herein in its entirety. Turning to the percutaneous bone conduction device of FIG. 3B, the transmission element 306*b* can be connected to a bone anchor system 308*b* in the form of a screw. The bone anchor system 308*b* is secured directly to the skull S of a recipient.

Figure 4:
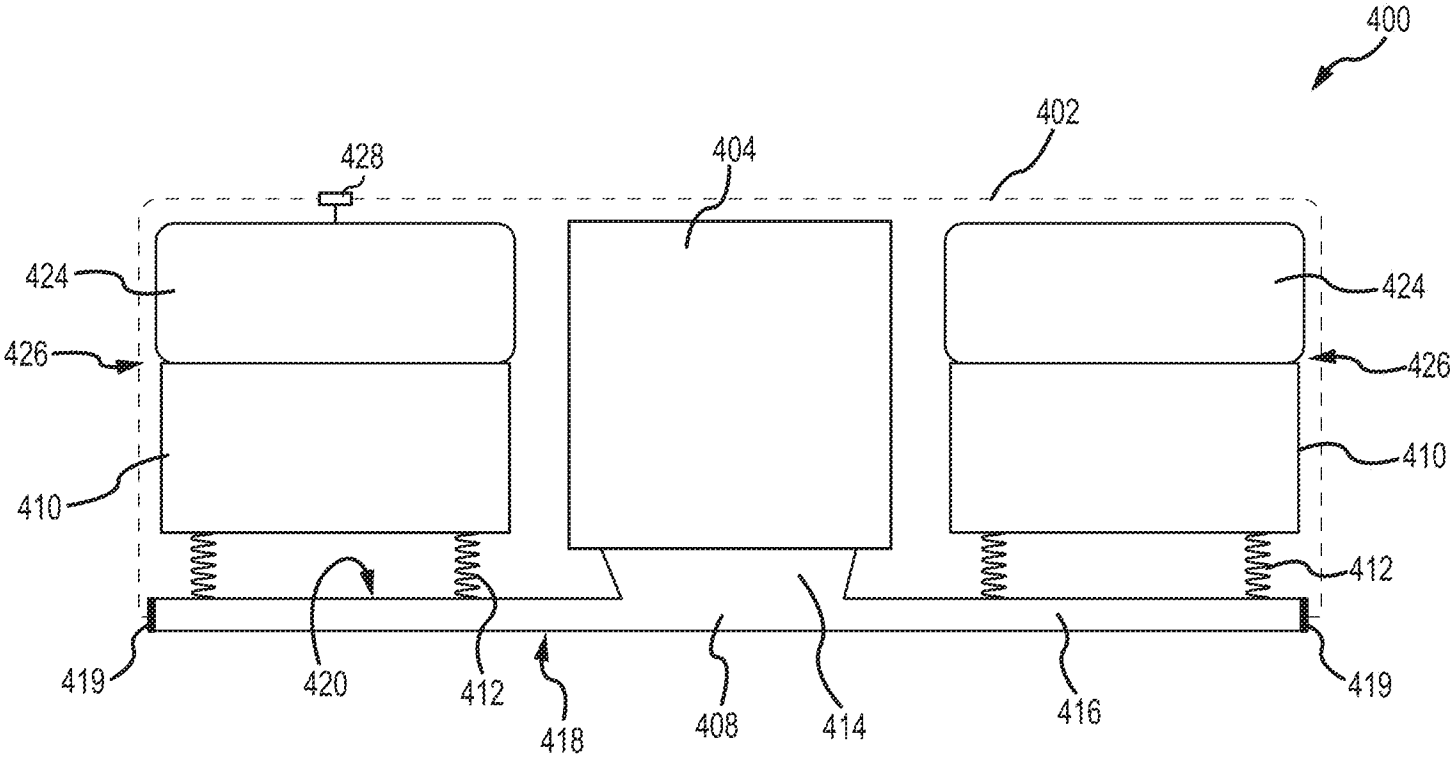
FIG. 4 depicts a partial cross-sectional schematic view of an external portion of a transcutaneous bone conduction device.

FIG. 4 depicts a partial cross-sectional schematic view of another aspect of an external portion 400 of a transcutaneous bone conduction device. The external portion 400 includes a housing 402 in which is disposed a vibration element 404. The vibration element 404 is connected to a transmission element 408 that is seated within an opening in the housing 402. Thus, the external portion 400 of FIG. 4 is utilized in a dedicated transcutaneous bone conduction application, unlike certain of the previous examples that can be interchanged between transcutaneous and percutaneous applications. In the depicted aspect, the transmission element 408 includes a shaft 414 connected to or integral with a plate 416. As in the previous examples, the plate 416 has a lower surface 418 adapted to contact the skin of a recipient, as well as an upper surface 420. Additionally, a sealing and suspension system 419 is disposed between the housing 402 and the transmission element 408 (e.g., at the outer perimeter of the plate 416). Resilient members 412 flexibly connect the upper surface 420 to one or more masses 410. The external portion 400 also includes a number of additional components 424 required for the functionality of the external portion 400. These are described generally above and can include a battery, electronics, wireless communication devices, and so on. A sound input element such as a microphone 428 is disposed on the housing 402 and in communication with the sound processor component 424. To further reduce feedback, the components 424 can be connected to the masses 410 at interfaces 426.

Figure 5A:
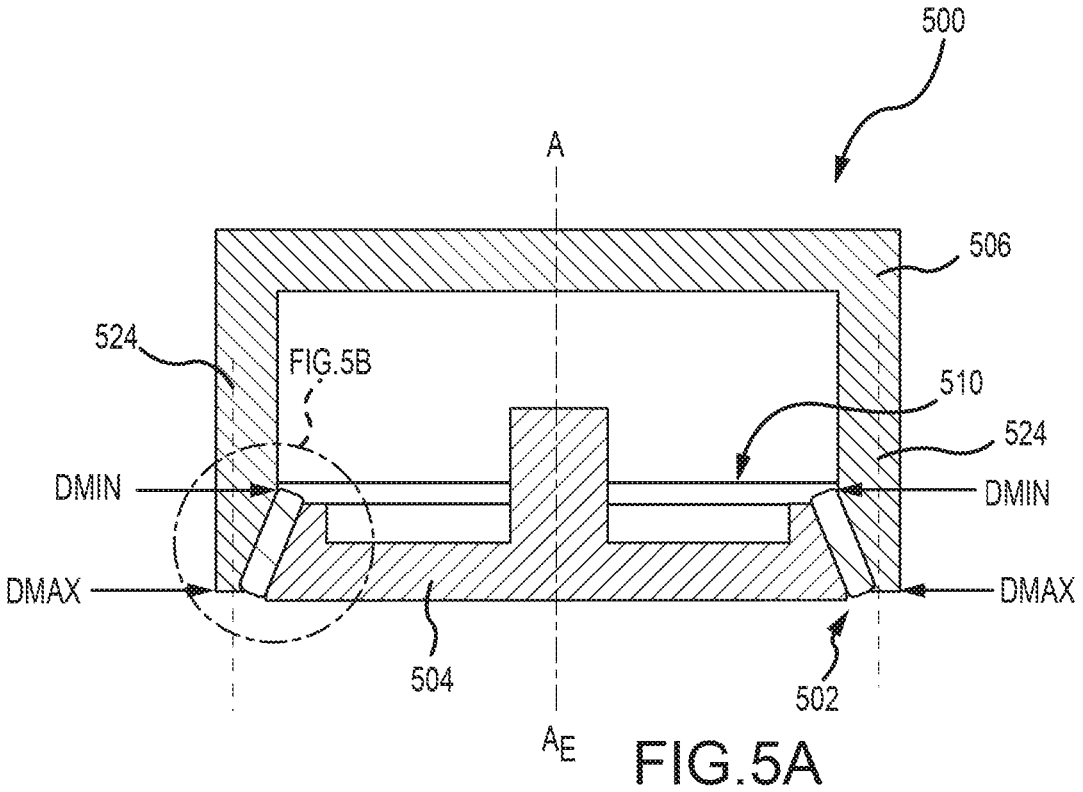
FIG. 5A depicts a partial cross-sectional schematic view of a bone conduction device utilizing an aspect of a sealing and suspension system.
Figure 5B:
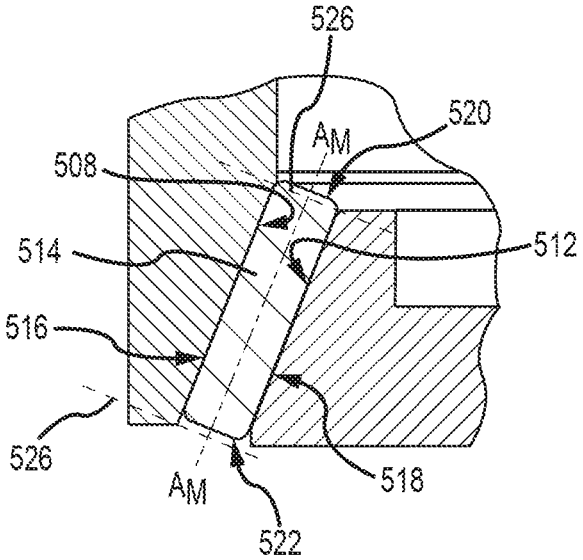
FIG. 5B depicts an enlarged partial cross-sectional schematic view of the bone conduction device of FIG. 5A.

FIG. 5A depicts a partial cross-sectional schematic view of a bone conduction device 500 utilizing an aspect of a sealing and suspension system 502. FIG. 5B depicts an enlarged partial cross-sectional schematic view of the bone conduction device 500 of FIG. 5A, and is described simultaneously therewith. The depicted bone conduction device 500 is a transcutaneous bone conduction device, due to the utilization of a transmission element 504 in the form of an enlarged plate that delivers vibrations through the skin of a recipient. The sealing and suspension system 502 described in conjunction therewith can also be utilized with percutaneous bone conduction devices, where the transmission element is connected to an anchor extending from the skull of the recipient. The transmission element 504 defines an actuation axis A, along which the transmission element 504 reciprocally vibrates during actuation. A housing 506 contains components (not depicted, but described elsewhere herein) required for operation of the device 500. The housing 506 is generally rigid and includes an interface surface 508 that defines an opening 510 through which the transmission element 504 extends. In the depicted aspect, the interface surface 508 is pitched relative to the actuation axis A. In that regard, the opening 510 defines a maximum dimension or extent $D_{MAX}$ and a minimum dimension or extent $D_{MIN}$. The dimension, in certain examples, can be a diameter, for example, in aspects where the transmission element 504 is substantially round. Positioned generally in opposition to the interface surface 508 is an outer surface 512 of the transmission element 504. In the depicted aspect, the outer surface 512 is also pitched relative to the actuation axis A. The interface surface 508 and the outer surface 512 have approximately the same pitch in FIGS. 5A and 5B. A substantially annular elastic element 514 is disposed between the interface surface 508 and the outer surface 512, so as to form the sealing and suspension system 502.

Like the interface surface 508 and the outer surface 512, the elastic element 514 is also pitched relative to the actuation axis A. In certain aspects, the elastic element 514 can be pitched at an angle of about 70° to the actuation axis A. In other examples, the elastic element can be at an angle between about 90° (unpitched) to about 60° to the actuation axis A. In other examples, the elastic element can be at an angle between about 90° (unpitched) to about 45° to the actuation axis A. In other examples, the elastic element can be at an angle between about 60° to about 45° to the actuation axis A. More specifically, the elastic element 514 includes an outer periphery 516 disposed proximate the interface surface 508 and an inner periphery 518 disposed proximate the outer surface 512. The elastic element 514 defines an element axis $A_E$ that is substantially parallel to, and in some examples coaxial with, the actuation axis A. However, the elastic element 514 also defines a material axis $A_M$ that, in certain examples, can be parallel to, orthogonal to, or disposed at an angle to the actuation axis A. In certain examples, the material axis $A_M$ is defined by a cross-section of the elastic element 514. For example, the material axis $A_M$ can be substantially parallel to, and disposed substantially equidistant from, both of the outer periphery 516 and the inner periphery 518. The periphery of the elastic element 514 can also be defined by an upper periphery 520 and a lower periphery 522, and the material axis $A_M$ can be disposed substantially orthogonal to the upper periphery 520 and the lower periphery 522. The elastic element 514 has a total material volume that is banded and defined by the outer periphery 516, inner periphery 518, upper periphery 520, and lower periphery 522.

In order to ensure proper sealing of the opening 510 and support of the transmission element 504, the elastic element 514 is configured so as to be disposed within the maximum extent $D_{MAX}$ of the opening 510. That is, if the opening 510 defines a circular cross section of a cylinder having an axis coaxial with actuation axis A and having walls 524 parallel to the actuation axis A, the outer periphery 516 of the elastic element 514 is entirely disposed within that cylinder defined by the maximum extent $D_{MAX}$. Such a configuration allows a significant amount of the total material volume of the elastic element 514 to be subject to (and therefore dampen) vibrations between the interface surface 508 and the outer surface 512, which provides for the most efficient use of the greatest quantity of material available in the elastic element 514. In the depicted aspect, substantially all of the total material volume of the elastic element 514 is bounded by the interface surface 508 and the outer surface 512, as depicted by lines 526.

Figure 6A:
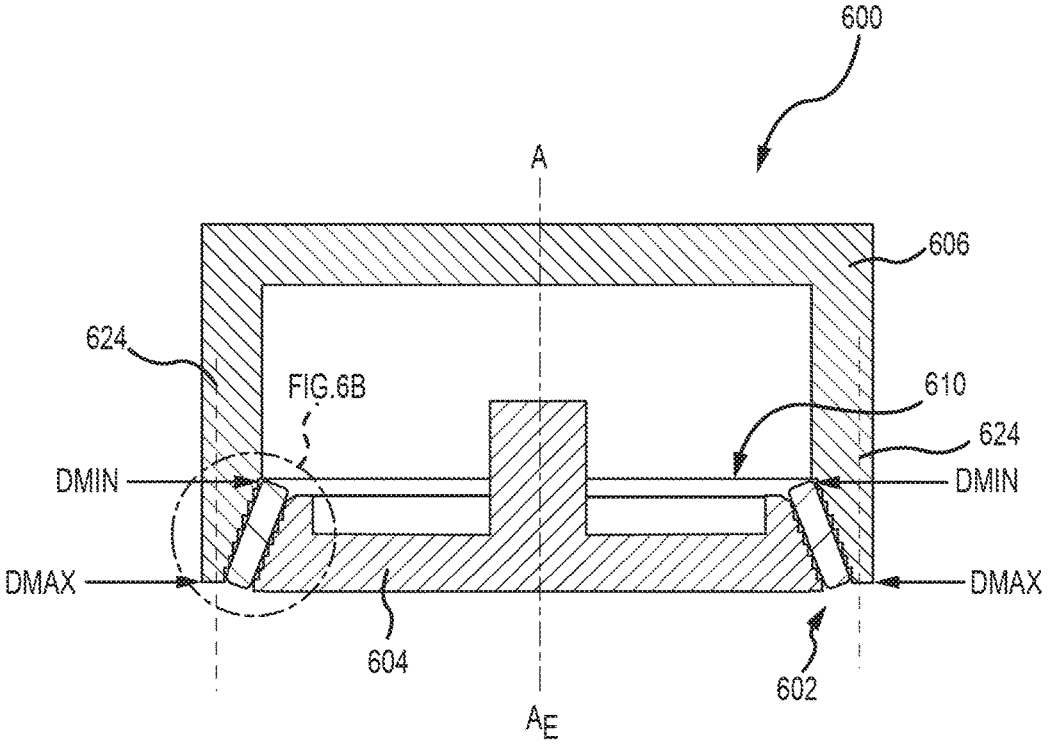
FIG. 6A depicts a partial cross-sectional schematic view of a bone conduction device utilizing another embodiment of a sealing and suspension system.
Figure 6B:
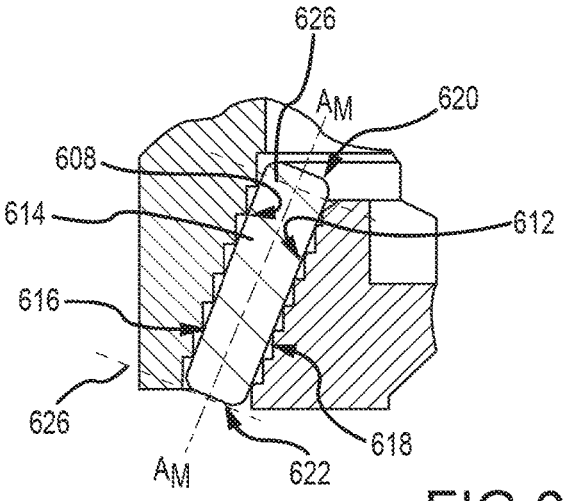
FIG. 6B depicts an enlarged partial cross-sectional schematic view of the bone conduction device of FIG. 6A.

FIG. 6A depicts a partial cross-sectional schematic view of a bone conduction device 600 utilizing an aspect of a sealing and suspension system 602. FIG. 6B depicts an enlarged partial cross-sectional schematic view of the bone conduction device 600 of FIG. 6A, and is described simultaneously therewith. Many of the components depicted in FIGS. 6A and 6B are also depicted and described with regard to FIGS. 5A and 5B. These components utilize similar reference numbers, beginning with 600, and are not necessarily described further. Notable differences between the bone conduction device 500 and bone conduction device 600 are described in more detail below.

In FIGS. 6A and 6B, an interface surface 608 includes a profile 650 that can include a pattern or texture. Serrated, toothed, and crenellated profiles are also contemplated. A similar profile 652 can be formed on an outer surface 612 of a transmission element 604. These profiles, 650, 652 form a plurality of discrete contact surfaces 654 or points along both an outer periphery 616 and an inner periphery 618 of the elastic element 614. Thus, adjacent contact surfaces 654 are separated by gaps 656 between the elastic element 614 and the interface surface 608 and the outer surface 612. These gaps 656 and contact surfaces 654 help reduce axial stiffness of the elastic element 614 as it is deflected during actuation of the transmission element 604, while still maintaining a robust seal.

Figure 7A:
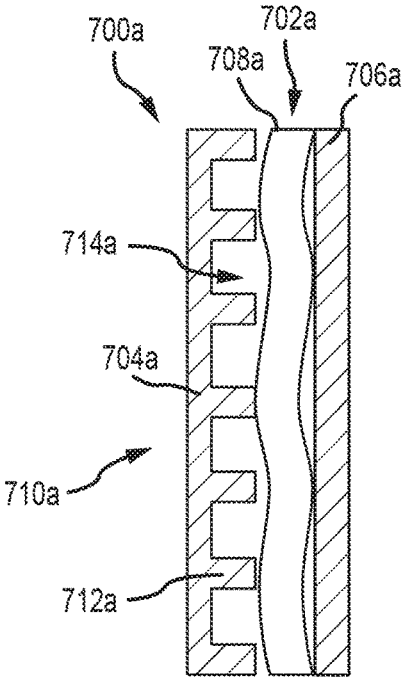
FIGS. 7A-7D depict enlarged partial cross-sectional schematic views of bone conduction devices utilizing alternative aspects of sealing and suspension systems.
Figure 7C:
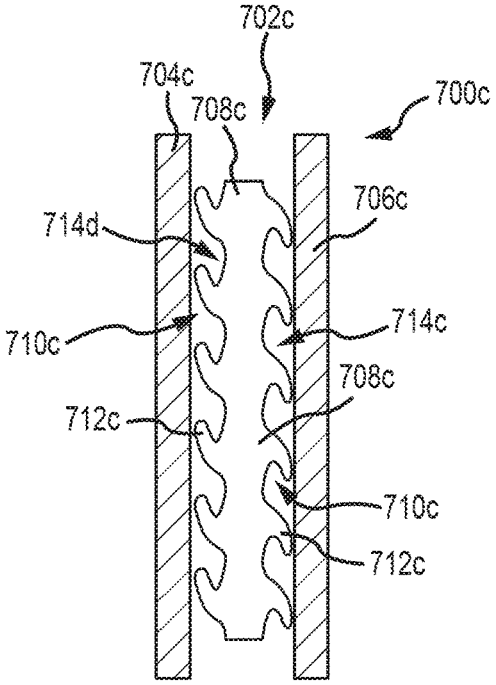
Figure 7B:
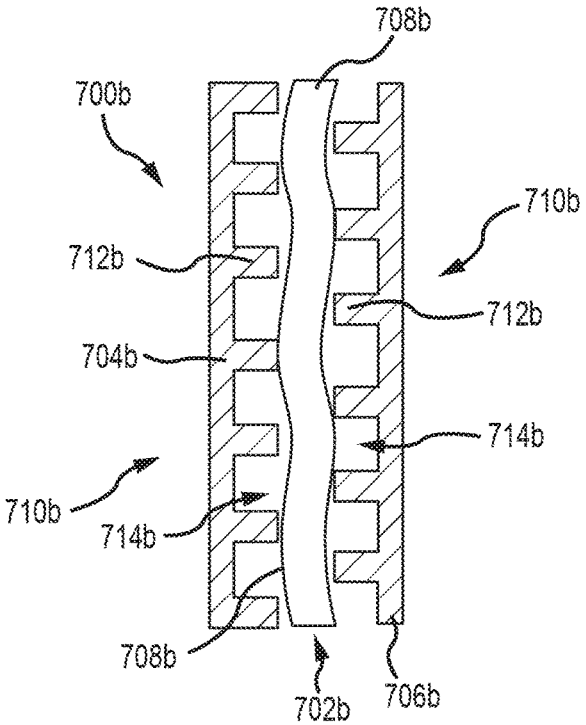
Figure 7D:
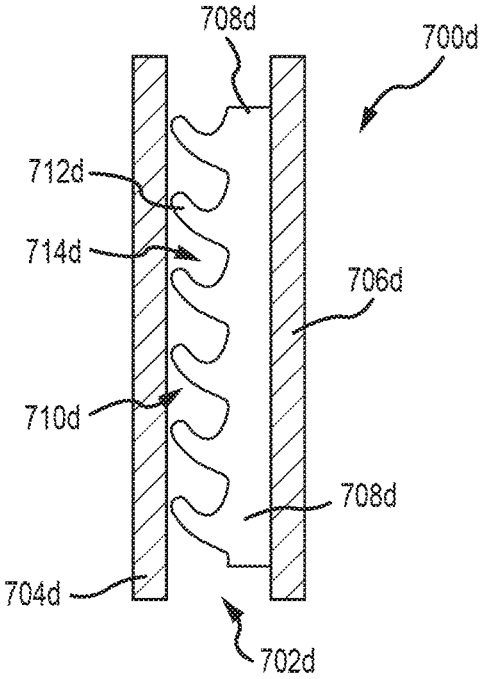

FIGS. 7A-7D depict enlarged partial cross-sectional schematic views of bone conduction devices 700*a-d* utilizing alternative aspects of sealing and suspension systems 702*a-d*. Each of FIGS. 7A-7D depict an interface surface 704*a-d* and an outer surface 706*a-d*, which correspond generally to those surfaces as described elsewhere herein. An elastic element 708*a-d* is disposed between the interface surface 704*a-d* and the outer surface 706*a-d*. In FIG. 7A, only the interface surface 704*a* includes a profile 710*a* that includes a plurality of teeth 712*a* that act as contact surfaces. Between adjacent teeth 712*a* are gaps 714*a* that help reduce axial stiffness of the elastic element 708*a*. In certain examples, these gaps 714*a* can be filled with an adhesive or other component to improve retention. In such examples, it can be advantageous that the adhesive displays very high flexibility so as to not reduce the overall flexibility attendant with utilization of the gaps. In FIG. 7B, both the interface surface 704*b* and the outer surface 706*b* include a profile 710*b*. In FIGS. 7C and 7D, neither the interface 704*c-d* nor the outer surface 706*c-d* include a profile. However, the elastic element 708*c-d* includes one or more surfaces having a profile 710*c-d*. In these cases, the profiles 710*c-d* include teeth 712*c-d* that form gaps 714*c-d* therebetween. Thus, in this configuration, axial stiffness of the elastic element 708*c-d* is also reduced.

It has been discovered that maintaining discrete contact surfaces (e.g., contact areas separated by non-contacting areas or gaps) between the interface surface and the elastic element and/or between the outer surface and the elastic element helps reduce axial stiffness of the elastic element. This is because that deflection caused by movement of transmission element only deforms and distorts areas of the elastic element proximate the discrete contact surfaces. During vibrations, portions of the elastic element are therefore able to deform into the gaps disposed between the discrete contact surfaces. By deforming a smaller volume of the elastic element proximate the interface and/or outer surfaces, the elastic element applies less return resistive force (e.g., stiffness) against the vibration transmission element. This improved performance is also present when the gaps are present between teeth formed on the elastic element.

Figure 8A:
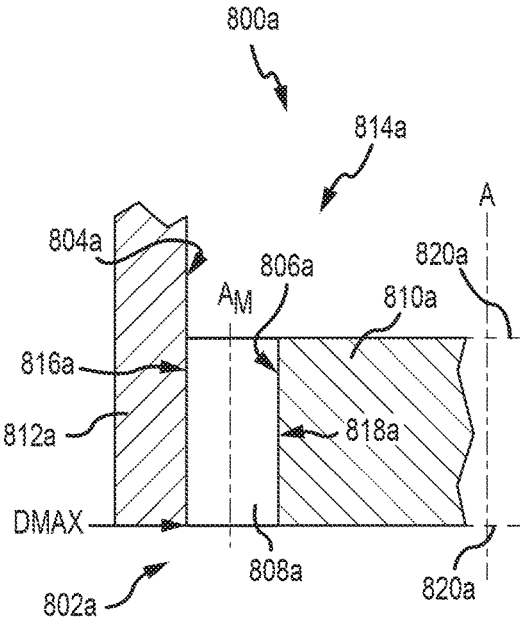
FIGS. 8A-8C depict enlarged partial cross-sectional schematic views of bone conduction devices utilizing alternative aspects of sealing and suspension systems.
Figure 8B:
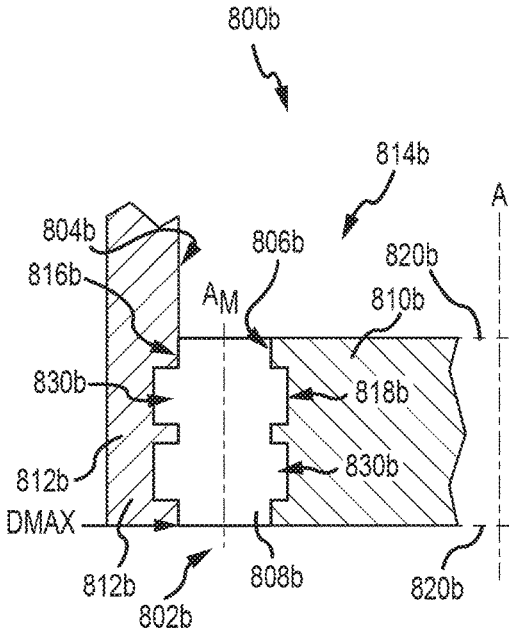
Figure 8C:
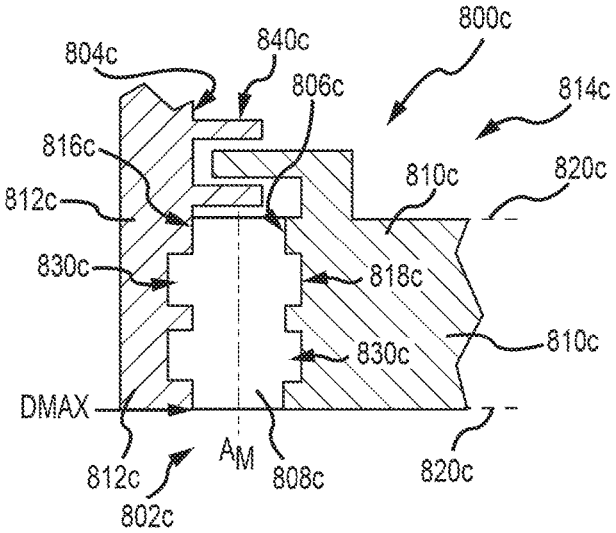

FIGS. 8A-8C depict enlarged partial cross-sectional schematic views of bone conduction devices 800*a-c* utilizing further alternative aspects of sealing and suspension systems 802*a-c*. Each of FIGS. 8A-8C depict an interface surface 804*a-d* and an outer surface 806*a-c*, which correspond generally to those surfaces as described elsewhere herein. An elastic element 808*a-c* is disposed between the interface surface 804*a-c* and the outer surface 806*a-c*.

In FIG. 8A, a transmission element 810*a* defines an actuation axis A, along which the transmission element 810*a* reciprocally vibrates during actuation. A housing 812*a* is generally rigid and includes the interface surface 804*a* that defines an opening 814*a* through which the transmission element 810*a* extends. Since the interface surface 804 is substantially parallel to the actuation axis A, the opening 814*a* defines a single maximum dimension or extent $D_{MAX}$. The elastic element 808*a* is annular, and includes an outer periphery 816*a* disposed proximate the interface surface 804*a* and an inner periphery 818*a* disposed proximate the outer surface 806*a*. The elastic element 808*a*, therefore, defines a material axis $A_M$ that, in certain examples, is defined by a periphery of a cross-section of the elastic element 808*a*. Here, the material axis $A_M$ is substantially parallel to, and disposed substantially equidistant from, both of the outer periphery 816*a* and the inner periphery 818*a*, and is also substantially parallel to the actuation axis A. As depicted in previous examples, the elastic element 808*a* is configured so as to be disposed within the maximum extent $D_{MAX}$ of the opening 814*a*. Moreover, to optimize the total volume of elastic element 808*a* available to dampen vibrations, substantially all of the total material volume is disposed between the interface surface 804*a* and the outer surface 806*a*, as depicted by lines 820*a*.

Turning to FIG. 8B, a transmission element 810*b* defines an actuation axis A, along which the transmission element 810*b* reciprocally vibrates during actuation. A housing 812*b* is generally rigid and includes the interface surface 804*b* that defines an opening 814*b* through which the transmission element 810*b* extends. Here, the interface surface 804*b* and the outer surface 806*b* each define one or more recesses 830*b*. The elastic element 808*b* includes an outer periphery 816*b* disposed proximate the interface surface 804*b* and an inner periphery 818*b* disposed proximate the outer surface 806*b*. The outer periphery 816*b* and an inner periphery 818*b* are formed to mate with the recesses 830*b*. This mating contact can help improve retention of the transmission element 810*b* in the housing 812*b* during vibration. Additionally, the interface surface 804*b* can also be textured or patterned, as described above. The elastic element 808*b* defines a material axis $A_M$ that, in certain examples, is defined by a periphery of a cross-section of the elastic element 808*b*. When split on the material axis $A_M$ the outer periphery 816*b* and the inner periphery 818*b* have cross sections that are substantially mirror images of each other. As depicted in previous aspects, to optimize the total volume of elastic element 808*b* available to dampen vibrations, the substantially all of the total material volume is disposed between the interface surface 804*b* and the outer surface 806*b*, as depicted by lines 820*b*. The sealing and suspension system 814*c* of FIG. 8C is substantially similar to that depicted in FIG. 8B, but includes a mechanical stop 840*c* to protect the sealing and suspension system 814*c* from excessive mechanical forces, which can occur, for example, if the bone conduction devices 800*c* is dropped.

Figure 9A:
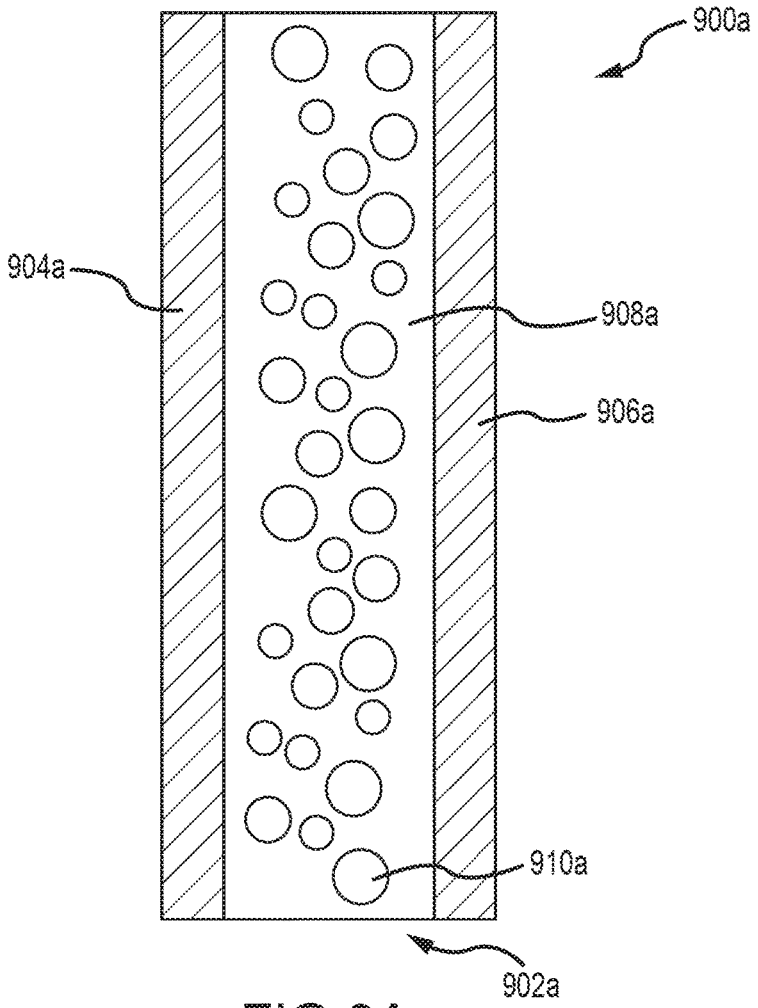
FIGS. 9A-9C depict enlarged partial cross-sectional schematic views of bone conduction devices utilizing alternative aspects of sealing and suspension systems.
Figure 9B:
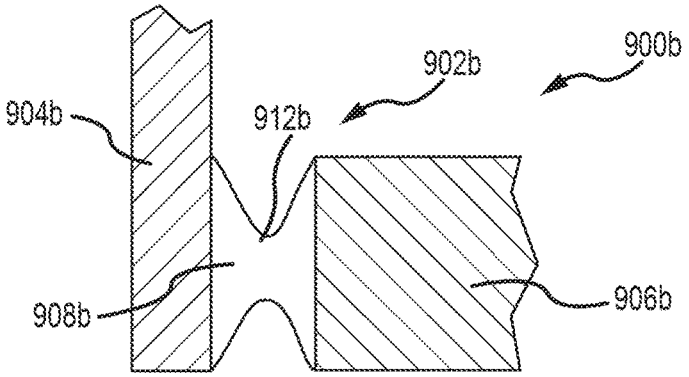
Figure 9C:
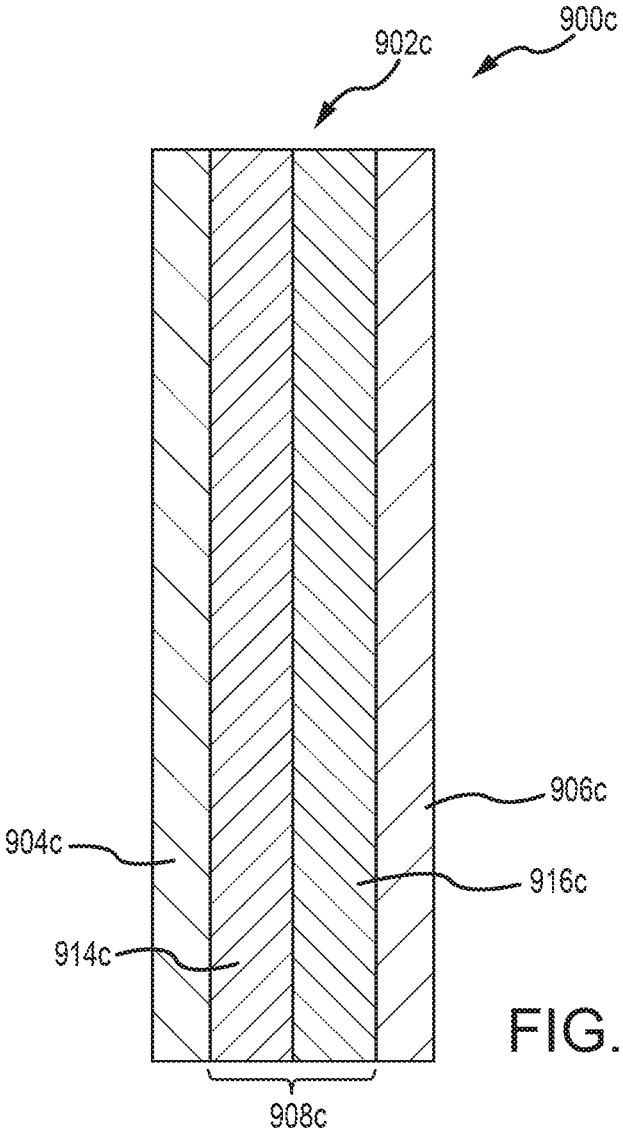

Other configurations of sealing and suspension systems can be utilized to provide damping functionality for a wide range of frequencies. For example, FIGS. 9A-9C depict enlarged partial cross-sectional schematic views of bone conduction devices 900*a-c* utilizing alternative aspects of sealing and suspension systems 902*a-c*. A housing 904*a-c* and a transmission element 906*a-c* are depicted. In FIG. 9A, an elastomer element 908*a* includes a plurality of air cells 910*a*, which reduces stiffness of the elastomer element 908*a*. In FIG. 9B, an elastomer element 908*b* has an hour-glass or tapered shape. This allows for different parts of the elastomer element 908*b* to dominate in different frequency ranges. For example, in the depicted aspect, the thinner central portion 912*b* part is active at higher frequencies (e.g., lower displacements), while the whole elastomer element 908*b* is active at lower frequencies (e.g., larger displacements). FIG. 9C an elastomer element 908*c* is manufactured from two materials 914*c*, 916*c*. Utilizing two materials 914*c*, 916*c* in series, as depicted, provides damping in wider frequency range.

Figure 10:
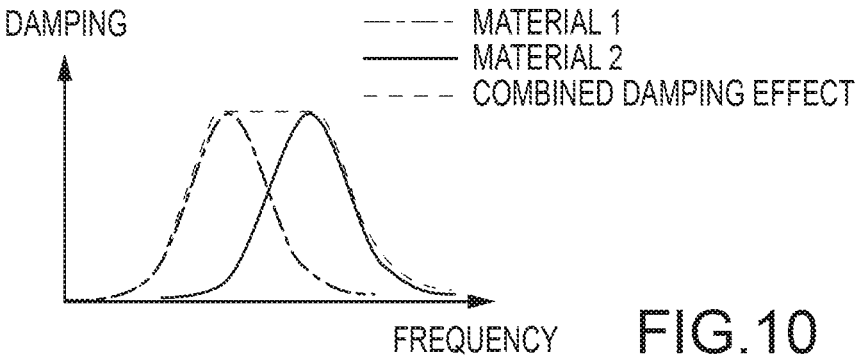
FIG. 10 depicts a relationship between frequency and damping, for a sealing and suspension system that utilizes two materials.

For example, FIG. 10 depicts a relationship between frequency and damping, for a sealing and suspension system that utilizes two viscoelastic materials. In general, damping as a function of frequency through a viscoelastic material can be defined by a bell-shaped curve (as indicated by the curves associated with Material 1 and Material 2, individually). By combining two materials with different maximum damping frequencies in series (e.g., as depicted in FIG. 9C), a wider range of frequencies of vibrations through the two-material-layer can be dampened effectively, as compared to only using one material.

This disclosure described some aspects of the present technology with reference to the accompanying drawings, in which only some of the possible aspects were shown. Other aspects, however, can be embodied in many different forms and should not be construed as limited to the examples set forth herein. Rather, these examples were provided so that this disclosure was thorough and complete and fully conveyed the scope of the possible examples to those skilled in the art.

Although specific aspects were described herein, the scope of the technology is not limited to those specific aspects. One skilled in the art will recognize other aspects or improvements that are within the scope of the present technology. Therefore, the specific structure, acts, or media are disclosed only as illustrative examples. The scope of the technology is defined by the following claims and any equivalents therein.

What is claimed is:

1. An apparatus comprising:

a rigid housing comprising an interface surface defining an opening through a wall of the rigid housing;

a vibration transmission element extending at least partially through the opening and configured to actuate reciprocally along an actuation axis, wherein the vibration transmission element comprises an outer surface facing the interface surface; and an elastic element disposed within the opening between the interface surface and the outer surface, wherein the elastic element is pitched relative to the actuation axis.

2. The apparatus of claim 1, wherein the elastic element comprises an inner periphery and an outer periphery and a material axis disposed substantially parallel to both the inner periphery and the outer periphery.

3. The apparatus of claim 2, wherein the opening defines a maximum extent, and wherein the outer periphery is disposed within the maximum extent.

4. The apparatus of claim 1, wherein the opening defines a maximum diameter, and wherein the elastic element is disposed entirely within the maximum diameter.

5. The apparatus of claim 2, wherein the inner periphery is disposed proximate the outer surface and wherein the outer periphery is disposed proximate the interface surface.

6. The apparatus of claim 2, wherein the material axis is disposed at an angle to the actuation axis.

7. The apparatus of claim 2, wherein the material axis is disposed substantially equidistant between the inner periphery and the outer periphery.

8. The apparatus of claim 1, wherein at least one of the interface surface and the outer surface comprises a profile comprising at least one of a patterned profile, a textured profile, a serrated profile, a toothed profile, and a crenellated profile.

9. The apparatus of claim 7, wherein the elastic element contacts the profile at a plurality of discrete contact surfaces.

10. The apparatus of claim 1, wherein the elastic element contacts at least one of the interface surface and the outer surface at a plurality of discrete contact surfaces, wherein adjacent discrete contact surfaces are separated from each other by a gap between the elastic element and the at least one of the interface surface and the outer surface.

11. The apparatus of claim 1, wherein the elastic element is annular and comprises a total material volume, substantially all of the total material volume being disposed between the interface surface and the outer surface.

12. The apparatus of claim 11, wherein the annular elastic element comprises:

an inner periphery disposed proximate the outer surface;

an outer periphery disposed proximate the interface surface;

an upper periphery; and a lower periphery, wherein the total material volume is defined by the inner periphery, the outer periphery, the upper periphery, and the lower periphery.

13. The apparatus of claim 12, wherein at least one of the inner periphery and the outer periphery comprises at least one of a patterned surface, a textured surface, a serrated surface, a toothed surface, and a crenellated surface.

14. The apparatus of claim 11, wherein the annular elastic element defines a plurality of air cells.

15. The apparatus of claim 12, wherein the annular elastic element defines a material axis substantially equidistant between, and parallel to, both the outer periphery and the inner periphery.

16. An apparatus comprising:

a rigid housing comprising a pitched interface surface defining an opening through a wall of the rigid housing, wherein the opening comprises a maximum diameter proximate an outer surface of the wall and a minimum diameter proximate an inner surface of the wall; and a vibration transmission element extending at least partially through the opening and defining an actuation axis, wherein the vibration transmission element comprises:

a stimulation surface; and an outer surface facing the interface surface, wherein the diameter of the stimulation surface is greater than the minimum opening diameter; and an elastic element pitched relative to the actuation axis and disposed between the interface surface and the outer surface.

17. The apparatus of claim 16, wherein at least one of the pitched interface surface, the outer surface, and the elastic element comprises a textured surface.

* * * * *